US007310084B2

(12) United States Patent
Shitanaka et al.

(10) Patent No.: US 7,310,084 B2
(45) Date of Patent: Dec. 18, 2007

(54) MULTI-WAY OPERATION SWITCH, INPUT DEVICE AND INPUT UNIT

(75) Inventors: Hitokazu Shitanaka, Fukui (JP); Koichi Santo, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 165 days.

(21) Appl. No.: 11/167,152

(22) Filed: Jun. 28, 2005

(65) Prior Publication Data

US 2005/0284737 A1 Dec. 29, 2005

(30) Foreign Application Priority Data

Jun. 29, 2004 (JP) ..... 2004-190688
Sep. 10, 2004 (JP) ..... 2004-263596

(51) Int. Cl.
*G09G 5/00* (2006.01)

(52) U.S. Cl. ..... 345/156; 345/157; 345/161; 345/163; 345/167; 345/184; 200/5 A; 200/6 A; 715/784; 715/787

(58) Field of Classification Search ..... 345/156, 345/157, 163–184
See application file for complete search history.

(56) References Cited

U.S. PATENT DOCUMENTS 4,636,963 A * 1/1987 Nakajima et al. ..... 700/238
5,952,628 A 9/1999 Sato et al.
6,184,480 B1 2/2001 Nishimoto et al.
6,707,387 B2 * 3/2004 Noguchi et al. ..... 340/691.6
7,038,667 B1 * 5/2006 Vassallo et al. ..... 345/184
2004/0189595 A1 * 9/2004 Yuasa et al. ..... 345/156

FOREIGN PATENT DOCUMENTS

| | | |
|---|---|---|
| DE | 103 39 469 | 3/2004 |
| EP | 0 977 226 | 5/2006 |
| JP | 8-318729 | 12/1996 |
| JP | 2001-266712 | 9/2001 |

* cited by examiner

*Primary Examiner*—Richard Hjerpe
*Assistant Examiner*—Jennifer T Nguyen
(74) *Attorney, Agent, or Firm*—Wenderoth, Lind & Ponack, L.L.P.

(57) ABSTRACT

A multi-way operation switch of the present invention includes an operation unit that is horizontally movable and rotatable; a plurality of first switch contacts for turning on and off the electrical coupling by horizontally moving the operation unit; and a second switch contact for turning on and off the electrical coupling by rotating the operation unit. This configuration allows the user to hold a single operation unit and operate multiple electronic apparatuses and setting modes by simply horizontally moving and rotating the operation unit. Accordingly, a smaller multi-way operation switch that is less prone to erroneous operation and which is easier to operate is achievable.

15 Claims, 6 Drawing Sheets

MULTI-WAY OPERATION SWITCH, INPUT DEVICE AND INPUT UNIT

BACKGROUND OF THE INVENTION

1. Field of the Invention

The present invention relates to multi-way operation switches, typically for operating vehicle electronic apparatuses, and input devices and input units employing multi-way operation switches.

2. Background Art

Increasing numbers of electronic apparatuses such as air conditioner and audio equipment are being installed in vehicles. Input devices with a plurality of switches corresponding to each specific electronic apparatus and setting mode are often installed on the dashboard. Accordingly, there is a need for a user-friendly input device that is less prone to erroneous operation.

A conventional input device of this type is described next with reference to FIG. 7.

As shown in FIG. 7, buttons 2 protrude through openings 1A on panel 1 made of insulating resin. Push switches (not illustrated) which electrically turn on and off by pushing buttons 2 are mounted at the back of buttons 2 on a printed circuit board (not illustrated).

A controller (not illustrated) configured with electronic components (not illustrated) such as a microcomputer is installed on this circuit board. The push switches are coupled to this controller to configure an input device.

This controller is also coupled to an electronic circuit (not illustrated), to which electronic apparatuses are coupled, typically via a connector. This configures the input device that transmits the ON/OFF signal of the push switches to the electronic circuit.

This input device is mounted on the dashboard facing the driver's seat. Buttons 2A and 2B for temperature control of an air conditioner output near the driver's seat, buttons 2C and 2D for adjusting the navigation display, buttons 2E and 2F for adjusting sound volume, and buttons 2G and 2H for temperature control of an air conditioner output near the passenger seat are disposed respectively in columns along panel 1. In FIG. 7, these buttons are indicated as TEMP1, NAVI, AUDIO-VOL and TEMP2.

In the above configuration, the user first needs to select button 2A among buttons 2A to 2H, for example, to increase the temperature of the air conditioner output near the driver's seat. When the user pushes button 2A, electrical connection of the push switch coupled to button 2A at the back is turned on or off. This ON/OFF signal is output from the controller to the electronic circuit in the vehicle, and finally the set temperature of the air conditioner output near the driver's seat increases.

To decrease the set temperature, the user selects and pushes button 2B underneath button 2A. This transmits the ON/OFF signal of an electrical connection corresponding to button 2B to the electronic circuit, and the set temperature of the air conditioner output decreases.

In the same way, the temperature of the air conditioner output near the passenger seat is controlled by pushing button 2G or 2H. The display screen of the navigation system is enlarged or reduced by pushing button 2C or 2D, and the sound volume is adjustable by pushing button 2E or 2F.

To change the sound volume of audio equipment, the user selects button 2E to increase the volume or button 2F to reduce it, and adjusts each setting mode by pushing these buttons.

In other words, a plurality of buttons 2A to 2H are provided individually for electronic apparatuses such as air conditioner and audio equipment, and for individual settings such as temperature and sound volume. The user can adjust the mode of the required apparatus by selecting the required button and pushing it.

This type of operation panel for vehicles is disclosed in the Japanese Patent Laid-open Application No. H8-318729.

A multi-way operation switch typically for controlling a car air conditioner is disclosed in the Japanese Patent Laid-open Application No. 2001-266712.

In the above conventional switch devices, a button and push switch are provided for each type of electronic apparatus such as air conditioner and audio equipment or for each setting mode, such as temperature and sound volume. Accordingly, the size of the input device becomes larger with increasing number of types of apparatus to be operated or setting modes for each piece of apparatus. Moreover, the operation is bothersome and erroneous operation is likely to occur, since the button to be pressed needs to be visually checked and operated every time. A switch device that can be more easily operated by drivers, in particular, is therefore needed.

SUMMARY OF THE INVENTION

A multi-way operation switch of the present invention includes an operation unit that is horizontally movable and rotatable; a plurality of first switch contacts for turning on and off the electrical coupling by horizontally moving the operation unit; and a second switch contact for turning on and off the electrical coupling by rotating the operation unit. This configuration allows the user to hold a single operation unit and operate multiple electronic apparatuses and setting modes by simply horizontally moving and rotating the operation unit. Accordingly, a smaller multi-way operation switch that is less prone to erroneous operation and which is easier to operate is achievable.

The multi-way operation switch of the present invention has a plurality of pushers and a shaft on a working member retained by a case in a rockable manner. These pushers radially extend in rocking directions. The shaft extends upward, and a rotor is mounted on the shaft in a rotatable manner. Electrical coupling of the first switch contacts turn on and off in accordance with the rocking of the working member, and electrical coupling of the second switch contact turns on and off in accordance with the rotation of the rotor. In other words, the first switch contacts are turned on and off by the rocking operation of the rotor, and the second switch contact is turned on and off by turning the rotor mounted on the working member. Accordingly, the user can choose a target electronic apparatus from multiple electronic apparatuses and adjust each setting mode through rocking and rotation while holding a single rotor.

The multi-way operation switch of the present invention further has a click mechanism, and this click mechanism provides the click feel when rocking the operation unit. The click feel provided when rocking ensures reliable operation and good tactile feedback.

The multi-way operation switch of the present invention further has a button at roughly the center of the rotor. In addition, a third switch is provided whose electrical connection turns on and off by pushing this button. Since electrical coupling of the third switch contact turns on and off by pushing the button at the center of the rotor, in addition to rocking of the working member and rotation of the rotor, operation of more electronic apparatuses and setting modes is made feasible.

An input device of the present invention has an operation unit which is horizontally movable and rotatable, and a controller. The controller selects a predetermined electronic apparatus or its mode in response to movement of the operation unit, and the selected apparatus or its mode is adjusted in response to rotation of the operation unit. The user can thus select and adjust electronic apparatuses and their modes by the movement and rotation of a single operation unit. Accordingly, a smaller input device that is less prone to erroneous operation and which is easier to operate is achievable.

The input device of the present invention also has a button, which can be pushed, on the operation unit and a push detector for detecting the pushing pressure on the button. This push detector is coupled to the controller. This configuration enables the operation of more apparatuses and modes.

The input device of the present invention is mounted on a panel in such a way that its operation unit is movable and rotatable. In addition, a plurality of displays are provided around the operation unit on the panel to configure the input unit. This achieves a smaller input unit which is easier to operate.

The input unit of the present invention also has a lighting device at the back of the displays. The controller lights a predetermined display in response to movement of the operation unit. Lighting of the display in response to movement of the operation unit offers an easily viewable display, further facilitating the operation.

DETAILED DESCRIPTION OF THE INVENTION

A multi-way operation switch of the present invention, and an input device and input unit employing the multi-way operation switch are described in the following exemplary embodiments.

First Exemplary Embodiment

Figure 1:
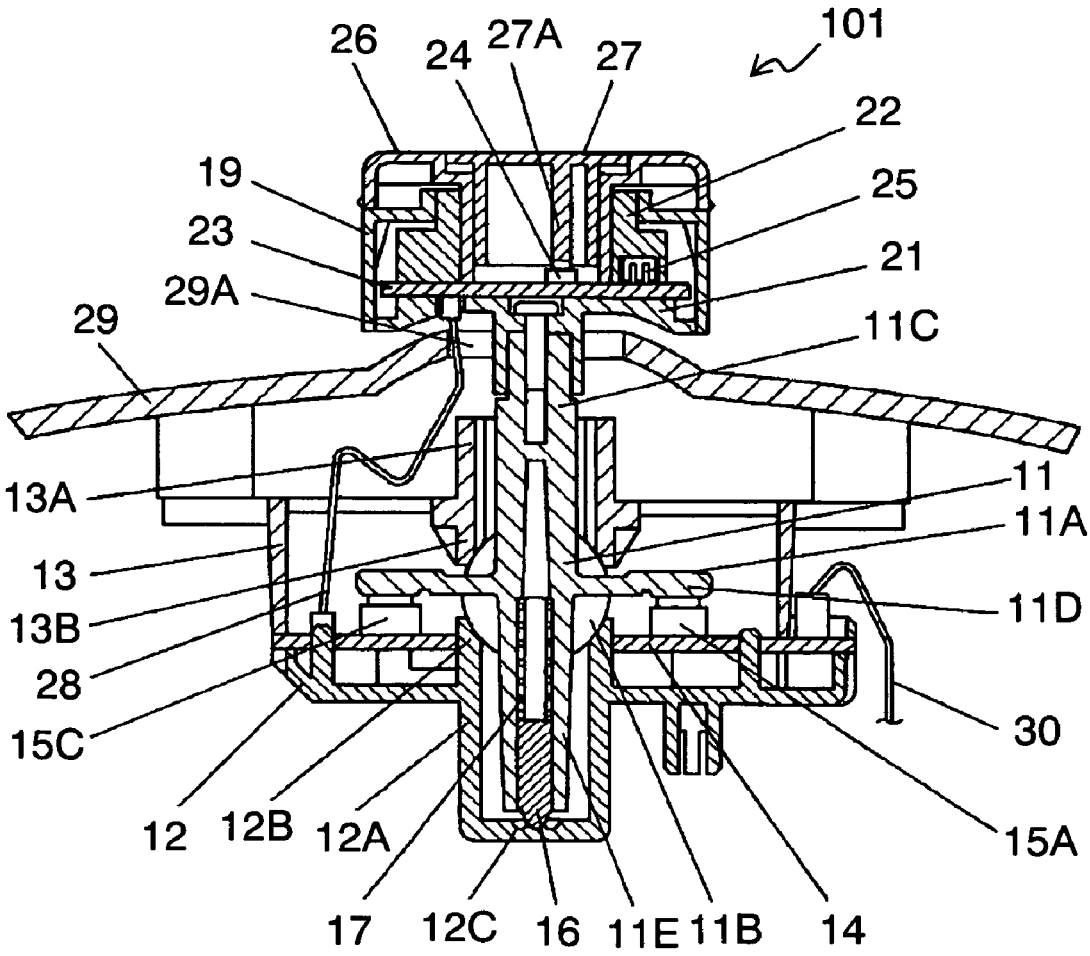
FIG. 1 is a sectional view of a multi-way operation switch in accordance with the first exemplary embodiment of the present invention.
Figure 2:
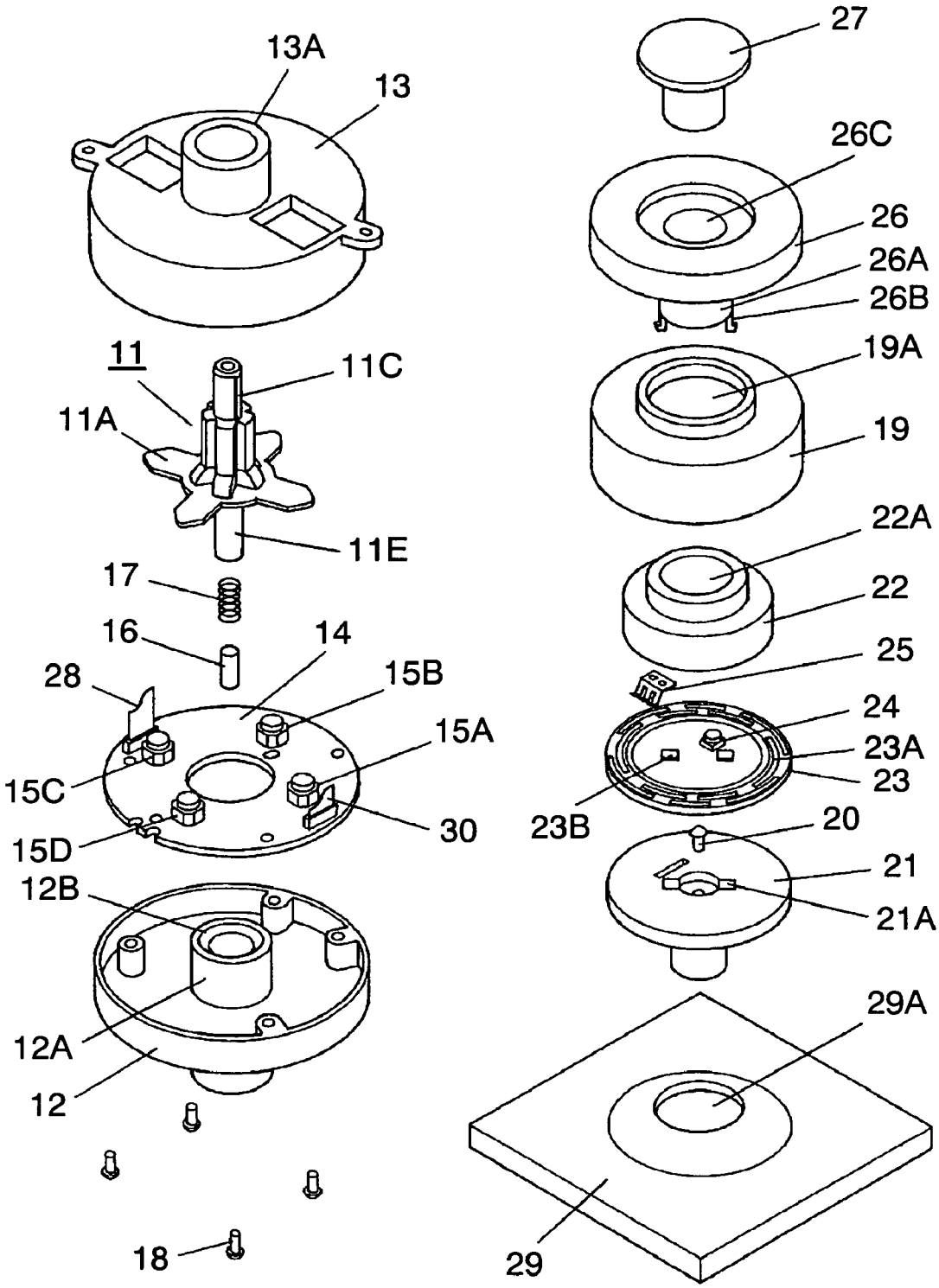
FIG. 2 is an exploded perspective view of the multi-way operation switch in accordance with the first exemplary embodiment of the present invention.

FIG. 1 is a sectional view and FIG. 2 is an exploded perspective view of multi-way operation switch 101 in accordance with the first exemplary embodiment of the present invention. Multi-way operation switch 101 in the first exemplary embodiment includes working member 11, case 12, cover 13, first printed wiring board 14, push switches (or lateral-movement-detection switch contacts) 15A to 15D, pin 16, spring 17, screws 18, rotor 19, screw 20, connector 21, driving element 22, second printed wiring board 23, push switch 24, movable piece 25, cap 26, button 27 and connector cable 28. Working member 11, rotor 19, driving element 22, push switch 24, cap 26 and button 27 together constitute an operation unit of switch 101. The operation unit excluding the working member is called a knob (or operating portion).

Each component is described next.

Working member 11 is a roughly cylindrical member made of insulating resin. This working member 11 has arms (or a switch-contact-pressing part) 11A radially extending in four directions, mutually crossing at the center, and roughly spherical fulcrum 11B formed on the base of arms 11A.

Roughly cylindrical lower guide 12A protrudes from roughly the bottom center of a dish-like case 12 made of insulating resin. Bowl-like lower retainer 12B is provided on an inner margin of the upper end of lower guide 12A.

Roughly cylindrical upper guide 13A protrudes vertically from roughly the center of cover 13 made of insulating resin. Bowl-like upper retainer 13B is formed on an inner margin of the lower end of upper guide 13A.

Lower retainer 12B of case 12 retains the bottom part of fulcrum 11B of working member 11, and the upper part of fulcrum 11B is retained by upper retainer 13B of cover 13 in a rockable manner in both retainers. Both ends of each arm 11A are positioned by a wall-like stopper (not illustrated) protruding inward of cover 13 so that working member 11 is restricted to rotating on the center of its axle.

First printed wiring board 14 has a plurality of conductive patterns (not illustrated) on its top and bottom faces. Push switches 15A, 15B, 15C and 15D mounted on the top face of first printed wiring board 14 are called first switch contacts, and are used for detecting horizontal (or rocking) movement of switch 101. The individual push switches 15A, 15B, 5C and 15D face pushers 11D formed on the bottom face of a tip of each arm 11A, and are mounted in roughly circular formation around the center hole. "Rocking" in the description refers to tilting of working member 11 to a predetermined angle in a predetermined direction from the upright position with respect to first printed wiring board 14. "Horizontal movement" refers to the movement of the knob of the operation unit in a predetermined direction for a predetermined distance with respect to first printed wiring board 14 typically by rocking working member 11. In other words, "horizontal movement" is the movement of rotor 19 roughly parallel to front panel 29 when the user holds rotor 19 and rocks it.

Ring groove 12C is formed on the inner bottom of lower guide 12A of case 12. Ring groove 12C is formed at the center of case 12, and includes a circular concave portion retaining the tip of pin 16, a convex portion surrounding it, and a concave portion concentrically formed around the convex portion. The concentric concave portion has a width, depth and sectional shape appropriate to retaining the tip of tilted pin 16. Roughly cylindrical pin 16 which has a roughly spherical tip, and coil spring 17 which is slightly compressed and applies a downward force to pin 16 are housed in housing hole 11E on the lower part of working member 11. The tip of pin 16 resiliently contacts ring groove 12C. This configures a click mechanism.

Also, case 12 and cover 13 are fixed by screws 18. Working member 11, push switches 15A to 15D, printed wiring board 14 and the click mechanism are housed in a space formed between case 12 and cover 13. Shaft 11C of working member 11 protrudes upward, passing through upper guide 13A.

Roughly cylindrical rotor 19 made of insulating resin, which has opening 19A at its center, and disk-like connector 21 fixed to the tip of shaft 11C by screw 20 are attached in a way such that rotor 19 is rotatable on connector 21.

Roughly cylindrical driving element 22 made of insulating resin, which has opening 22A at its center, is housed in rotor 19 such that driving element 22 is rotatable in response to rotor 19. The base of tongue-like movable piece 25 made of a thin elastic metal sheet is fixed to the bottom face of driving element 22.

Furthermore, second printed wiring board 23, fixed on the top face of connector 21, has fixed contact 23A which is formed of roughly arc-shaped conductive patterns on its top face. Multiply divided tips of movable piece 25 may resiliently contact this fixed contact 23A as to form the second switch contact (or rotation-detection switch contact) for detecting the rotation of the switch 101.

Push switch 24 is mounted on the top face of second printed wiring board 23 as a third switch contact for detecting the pushing pressure.

Roughly cylindrical cap 26, whose cylinder 26A protrudes downward at the center, covers around the periphery of the top end of rotor 19. Cylinder 26A passes through opening 22A of driving element 22. Catching members 26B, protruding from the tip of cylinder 26A, pass through holes 23B on printed wiring board 23, and are caught in catching holes 21A at the center of connector 21.

Roughly cylindrical button 27, made of insulating resin, is housed in opening 26C on cylinder 26A in a vertically movable manner, and pusher 27A provided on the bottom face of button 27 contacts an operating part on an upper part of push switch 24.

Second printed wiring board 23 and first printed wiring board 14 are also electrically coupled via connector cable 28.

The configuration of the multi-way operation switch in the first exemplary embodiment is described above.

As shown in FIG. 1, the multi-way operation switch in this exemplary embodiment is fixed to the bottom face of front panel 29 inside the vehicle by an attachment part on the circumference of cover 13. Rotor 19 and button 27, attached to an upper part of shaft 11C, protrude upward from opening 29A on front panel 29 after attachment to the vehicle, and printed wiring board 14 is coupled to an electronic circuit (not illustrated) of the vehicle, typically by connector cable 30. Accordingly, the user can operate rotor 19 and button 27 of the knob of the operation unit.

Next, the operation of the multi-way operation switch as configured above is described.

First, as shown in FIG. 1, the tip of pin 16, given force by spring 17, resiliently contacts the concave portion at the center of ring groove 12C when working member 11 is upright in its neutral position. Working member 11 is thus retained in the neutral position.

When button 27 at the upper part of the knob is pushed straight down from this state, push switch 24 is pushed by pusher 27A, and thus electrical connection is turned on or off. This ON/OFF signal is transmitted from printed wiring board 14, via connector cable 30, and so on to the electronic circuit in the vehicle. For example, a display indicating the state of each electronic apparatus is thus turned on. Accordingly, push switch 24 is one element of the push detector.

Figure 3:
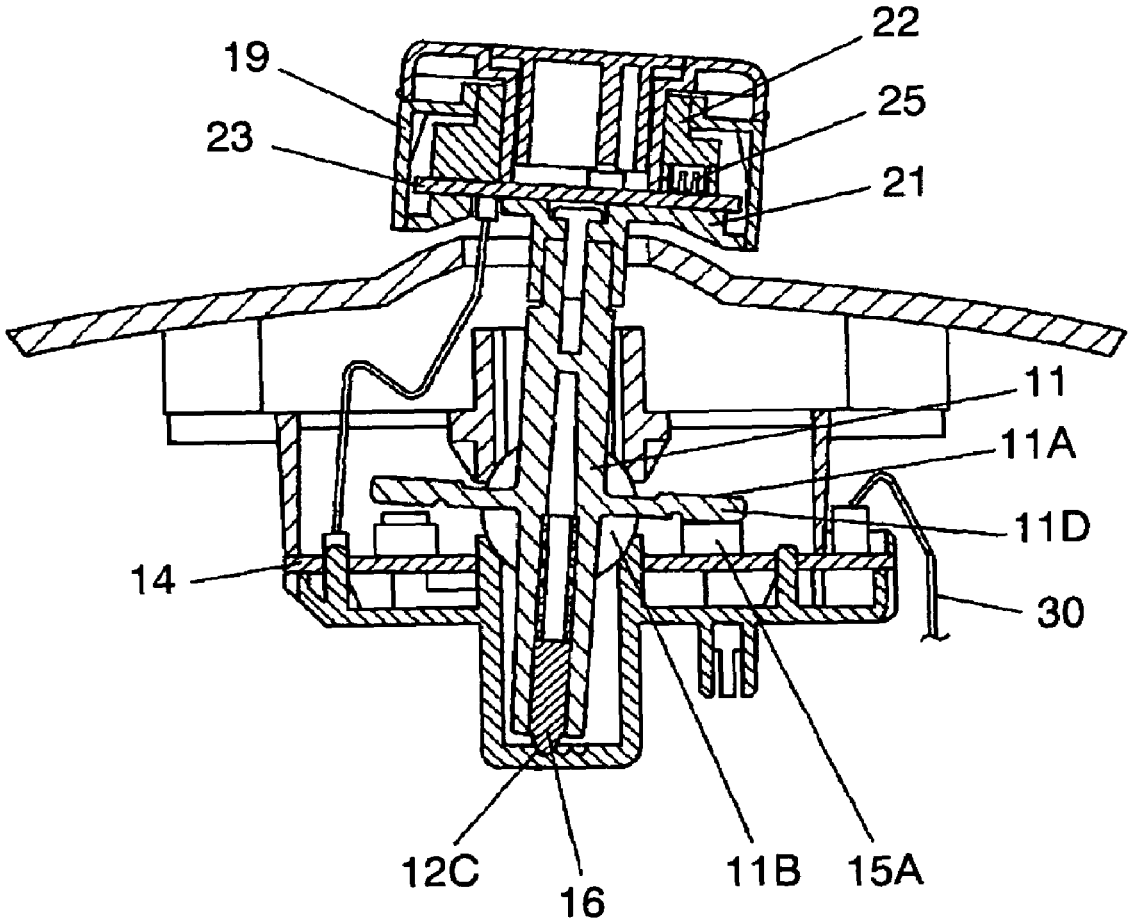
FIG. 3 is a sectional view of the multi-way operation switch when operated in accordance with the first exemplary embodiment of the present invention.

Next, as shown in a sectional view in FIG. 3, when the user holds the knob and rocks it rightward from the neutral position of the knob, working member 11 rocks rightward about fulcrum 11B via connector 21.

This makes pin 16 move from the center concave portion of ring groove 12C and, after resiliently riding over the convex portion around the center concave portion, pin 16 is shifted into the ring concave portion at the left. As a result, a click feel is provided when the user rocks rotor 19, and working member 11 is retained tilting rightward.

In addition, arm 11A at the right tilts downward as working member 11 rocks, and push switch 15A turns on or off when pusher 11D pushes push switch 15A. This ON/OFF signal is transmitted to the electronic circuit of vehicle via connector cable 30 coupled to printed wiring board 14, and, for example, temperature control of air conditioner becomes available. Push switches 15A to 15D are thus one element of the horizontal movement detector.

When the knob is rotated clockwise while working member 11 is tilted, driving element 22 rotates clockwise in response to the clockwise rotation of rotor 19, and the contact of movable piece 25 attached to the bottom of driving element 22 resiliently slides on a plurality of fixed contacts 23A. This operation electrically turns on or off fixed contacts 23A via movable piece 25. The second switch contact consisting of movable piece 25 and fixed contacts 23A are thus one element of the rotation detector.

For example, the temperature of the air conditioner output can be caused to increase when this ON/OFF signal is transmitted to the electronic circuit of the vehicle.

On the other hand, the temperature of the air conditioner output can be caused to decrease in response to this ON/OFF signal of the electrical coupling when rotor 19 is rotated counterclockwise while working member 11 is tilted rightward.

Next, when rotor 19 tilted rightward is tilted back to the center, the movement opposite to that described above is executed. More specifically, working member 11 rocks leftward with click feel, and returns to its neutral position. Through this operation, pusher 11D at the right of working member 11 moves upward, and push switch 15A returns to the OFF state.

If the knob remains to be held and rocked leftward, arm 11A at the left of working member 11 rocks and electrical coupling of push switch 15C turns on or off. This operation, for example, allows adjustment of audio equipment. When rotor 19 is rotated clockwise in this state, sound volume can be increased, and decreased if rotated counterclockwise.

In the same way, if the knob is rocked back and forth, electrical coupling of push switches 15B or 15D is turned on or off. This operation, for example, allows the control of apparatuses such as the radio tuner and CD player. More specifically, the radio tuner can be tuned and a CD track can be selected by rotating rotor 19 while tilting the knob forward or backward.

In other words, the apparatus to be adjusted can be selected by holding rotor 19 and rocking it backward and forward, or from side to side. The setting mode, such as temperature or volume, is then adjustable by rotating rotor 19 while it is being tilted.

As described above, the multi-way operation switch in this exemplary embodiment houses working member 11 in case 12 in a rockable manner. Working member 11 has pushers 11D extending radially in the rocking directions and shaft 11C extending upward. Rotor 19, which is rotatable, is attached to shaft 11C. When the operation unit is rocked, the electrical coupling of push switches 15A to 15D used for detecting horizontal movement turns on or off. On the other hand, the electrical coupling between movable piece 25 and fixed contacts 23A turn on or off in response to rotation of rotor 19, and the rotation is detected. In other words, the present invention allows selection from multiple electronic apparatuses and operation of the setting mode of a selected apparatus by holding single rotor 19 and rocking or rotating this rotor 19. Accordingly, a smaller and user-friendly multi-way operation switch which is less prone to erroneous use can be offered.

The above description refers to the multi-way operation switch which can be rocked in four directions: front, back, left and right. It is apparent that the present invention is applicable to designs which rock in two directions, five directions and so on, depending on the purposes intended.

In the present invention, click feel is achieved in response to the rocking of working member 11 by providing a click mechanism between working member 11 and case 12. The click mechanism is configured with pin 16, spring 17 applying force to pin 16, and ring groove 12C to which the tip of pin 16 resiliently contacts. This achieves good click feel and ensures accuracy of operation.

Also, the depth of the concave and convex portions of ring groove 12C can be set appropriately to configure an auto-recovery system in which working member 11 is given sufficient force to return to the neutral position automatically when the hand is released from rotor 19 after rocking working member 11.

Furthermore, the pushing force is detectable by disposing button 27 which is vertically movable at roughly the center of driving element 22 and push switch 24 which is electrically turned on and off by vertically pushing button 27. This configuration allows more electronic apparatuses and setting modes to be added, since the pushing operation of button 27 is available in addition to rocking and rotation of rotor 19.

Additionally, the first exemplary embodiment refers to the configuration of electrically turning on and off movable piece and fixed contacts 23 as the second switch contact. Instead of this configuration, however, the present invention is also achievable by forming a resistance pattern on the printed wiring board; and providing a variable resistor, to which a brush contact resiliently contacts, on its top face.

The idea of the multi-way operation switch of the present invention can also include the horizontal movement of the entire working member in addition to the horizontal movement as a result of rocking the working member.

Furthermore, the present invention can be designed to allow rotation of the working member only when the working member is being horizontally moved or rocked. This gives the user feedback on whether an electronic apparatus is being selected or controlled.

The multi-way operation switch of the present invention is downsized, less prone to erroneous operation, and easier to operate, and thus it is advantageous as an operating device for a range of electronic apparatuses installed chiefly in vehicles.

Next, an exemplary embodiment of the present invention is described with reference to FIGS. 4 to 6.

Second Exemplary Embodiment

An input device and input unit employing the multi-way operation switch described in the first exemplary embodiment are described in the second exemplary embodiment. The same components are given the same reference numerals in the description.

Figure 4:
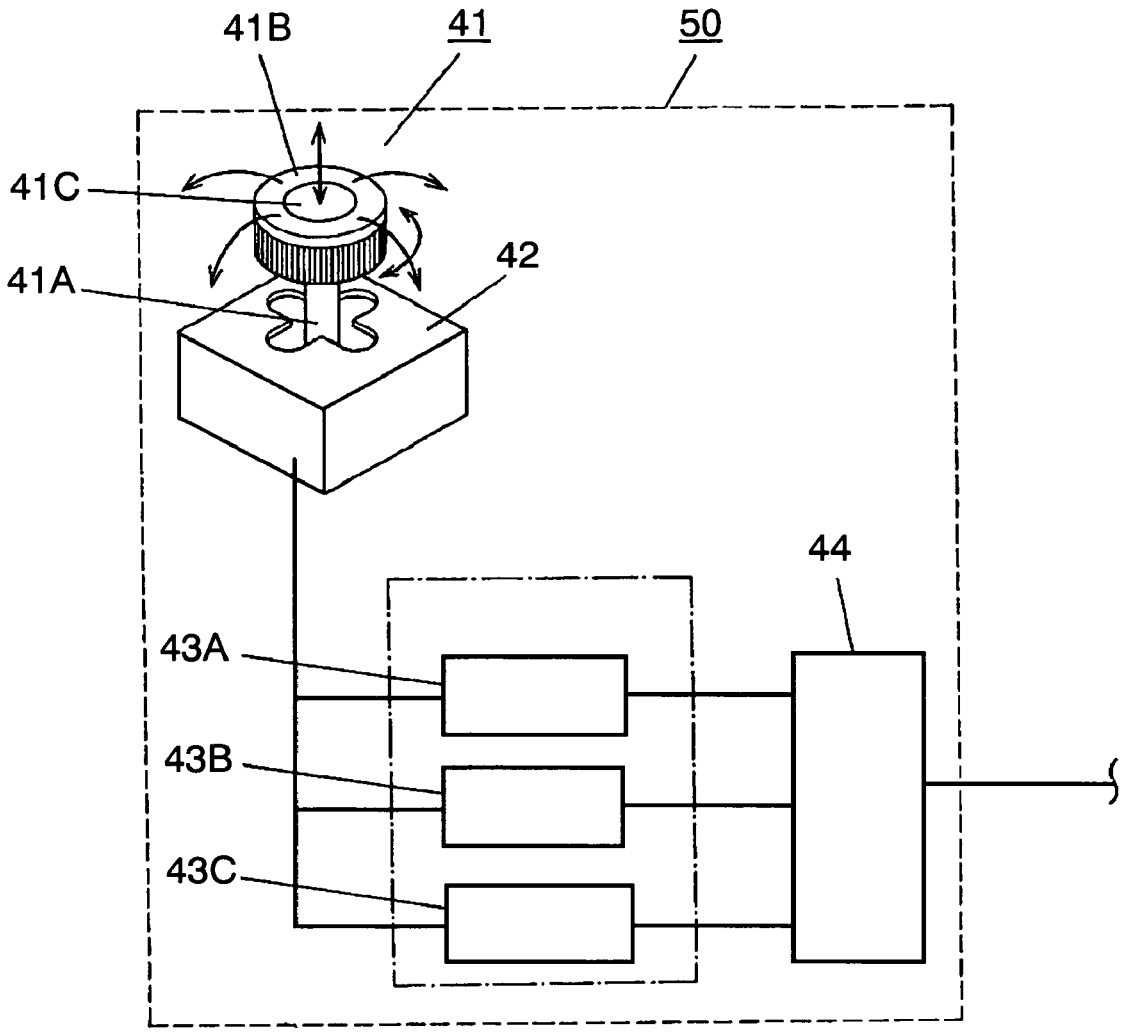
FIG. 4 is a block circuit diagram of an input device in accordance with the second exemplary embodiment of the present invention.

FIG. 4 is a block circuit diagram of the input device in this exemplary embodiment of the present invention.

Input device 50 in the second exemplary embodiment includes operation unit 41, horizontal movement detector 43A, rotation detector 43B, push detector 43C and controller 44. Each component is detailed below.

Operation unit 41 made of insulating resin includes shaft 41A and roughly cylindrical knob 41B rotatably mounted on the top end of shaft 41A. The bottom end of shaft 41A is retained in box-like case 42 in a rockable manner in each direction of front, back, left and right. Operation unit 41 further has button 41C which can be pushed downward (i.e., vertically) at roughly the center of the top face of knob 41B. Operation unit 41 corresponds to working member 11, rotor 19, driving element 22, push switch 24, cap 26, button 27, etc. of the multi-way operation switch in the first exemplary embodiment.

Input device 50 has horizontal movement detector 43A for detecting the rocking direction (i.e. horizontal movement direction) of operation unit 41. The "horizontal movement direction" refers to the operation of moving operation unit 41 roughly parallel to case 42, and thus the movement of operation unit 41 by rocking is also included in the operation in the horizontal movement direction.

Horizontal movement detector 43A is configured with a plurality of switch contacts such as push switches 15A to 15D. Push switches 15A to 15D are pushed by arms 11A, extending to front, back, left and right, on the bottom end of shaft 41A in case 42 when operation unit 41 rocks, and then electrical connection is turned on and off.

On the bottom end of shaft 41A, a click mechanism for retaining operation unit 41 in a tilted state is provided typically with ring groove 12C and spring 17 when operation unit 41 rocks.

Input device 50 further includes rotation detector 43B for detecting the rotating direction and rotating degree of operation unit 41. Rotation detector 43B is provided inside knob 41B, and is configured typically with a rotary encoder which inputs a predetermined pulse wave signal in response to the rotation of knob 41B.

Input device 50 further includes push detector 43C for detecting the pushing of button 41C. Push detector 43C is provided inside knob 41B, and detects a signal transmitted typically from push switch 24 disposed on the lower part of button 41C.

Controller 44 comprised of electronic components (not illustrated) such as a microcomputer is electrically connected to horizontal movement detector 43A, rotation detector 43B and push detector 43C. In addition, controller 44 is connected to multiple electronic apparatuses such as an air conditioner, audio equipment and a navigation system via an electronic circuit (not illustrated) in the vehicle.

The input device in this exemplary embodiment has the configuration described above.

Figure 5:
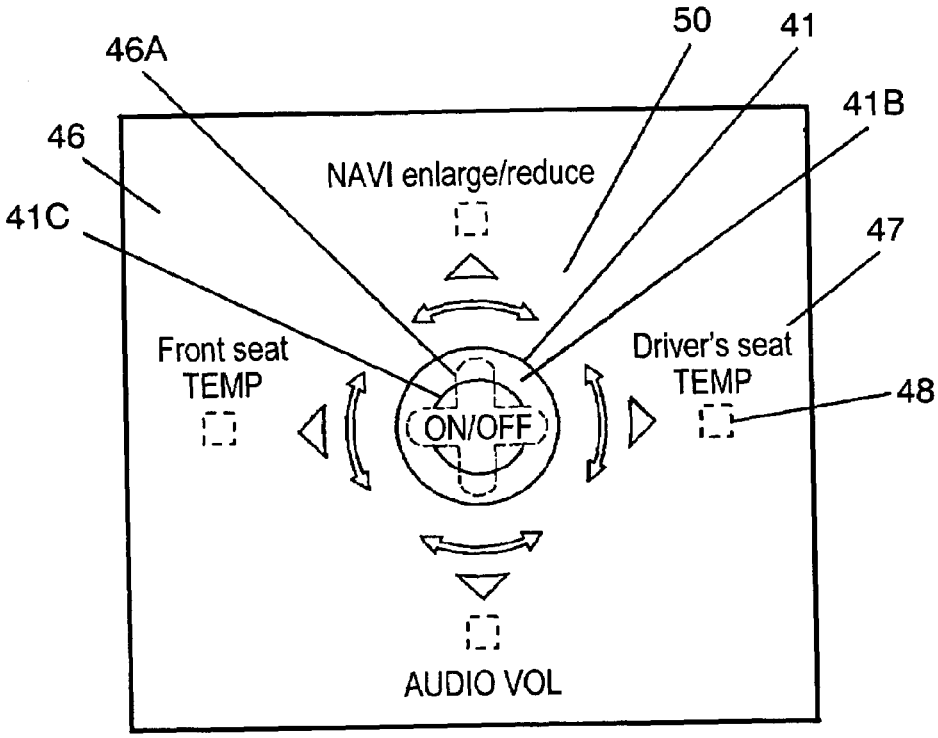
FIG. 5 is a plan view of an input unit in accordance with the second exemplary embodiment of the present invention.

FIG. 5 shows an example of an input unit employing this input device 50. The input unit shown in FIG. 5 is mounted on a dashboard at the front of the driver's seat. As shown in FIG. 5, the input unit in this exemplary embodiment of the present invention includes dark panel 46 in which opening 46A is formed, displays 47, lighting devices 48 and input device 50.

Shaft 41A of operation unit 41 passes through opening 46A, and knob 41B protrudes from the front face of panel 46.

Displays 47 such as light-transmitting characters and symbols typically indicating individual electronic apparatuses and modes corresponding to operating directions of operation unit 41 are provided around knob 41B on the front face of panel 46. Lighting devices 48 typically employing light-emitting diode or electro-luminescence element is provided on the rear face of these displays 47. These lighting devices 48 are electrically coupled to controller 44. In FIGS. 5 and 6, positions of displays 47 and lighting devices 48 are shifted to indicate both. It is apparent that these positions may be overlaid in the actual configuration.

Next, how the temperature output of the air conditioner near driver's seat is increased using the input unit of the exemplary embodiment of the present invention is described. The state shown in FIG. 5 is when operation unit 41 is held upright with respect to panel 46 in the neutral position. When knob 41B is rocked rightward, as shown in a plan view in FIG. 6, from the state in which operation unit 41 is upright, operation unit 41 rocks about the bottom end of shaft 41 as a fulcrum. By this movement, a predetermined push switch (e.g., 15A) in case 42 is pushed by arm 11A provided at the bottom portion of shaft 41A and electrical coupling is turned on or off.

This ON/OFF signal of the switch contact, i.e. a detection signal from horizontal movement detector 43A is output to controller 44, and temperature control of the air conditioner output near driver's seat becomes available.

At the same time, controller 44 turns on one of lighting devices 48 on the rear face of "Driver's seat TEMP" in displays 47 in response to rocking of operation unit 41, and thus "Driver's seat TEMP" is lighted so that the user can easily confirm which mode of which apparatus is selected.

Figure 6:
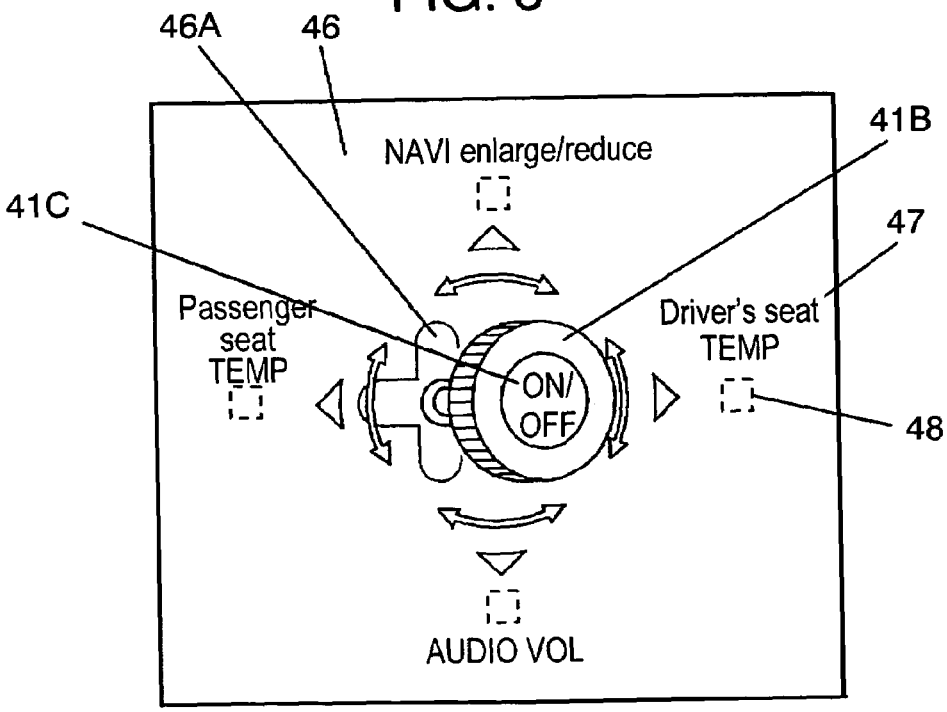
FIG. 6 is a plan view of the input unit when operated in accordance with the second exemplary embodiment of the present invention.
Figure 7:
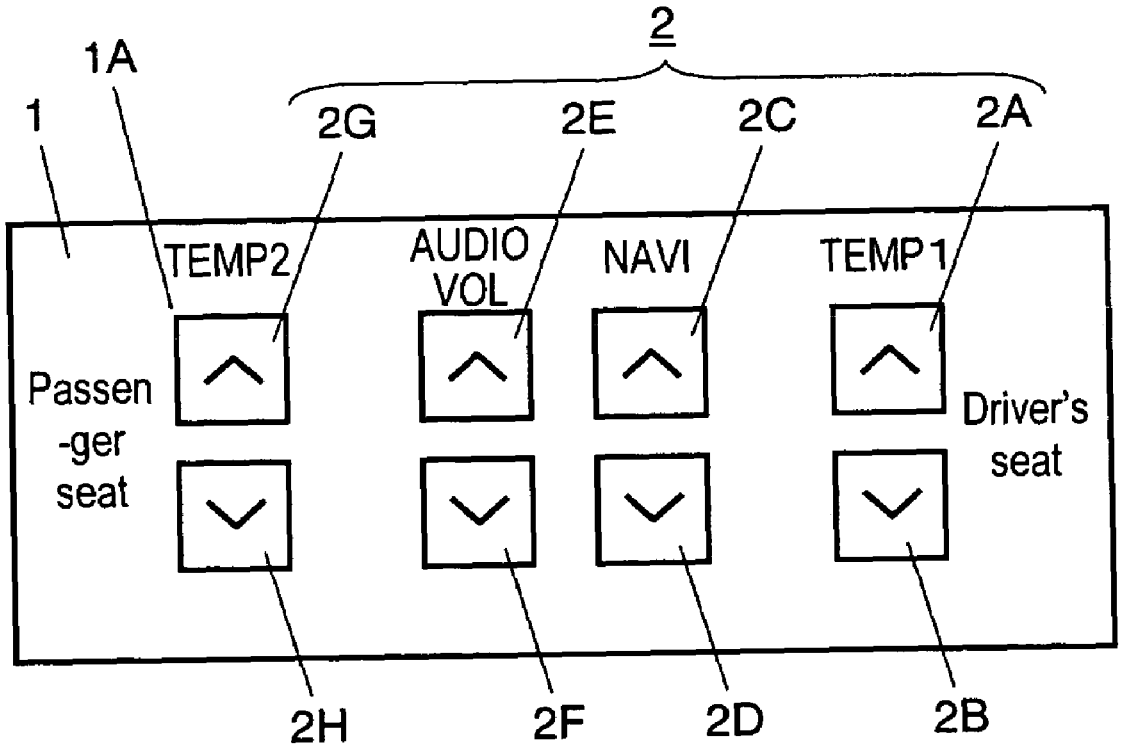
FIG. 7 is a plan view of a conventional input unit.

As shown in FIG. 6, when knob 41B is kept, for example, in the state that operation unit 41 is tilted rightward and then knob 41B is rotated clockwise, rotation detector 41B such as a rotary encoder electrically turns on or off. The detection signal from rotary detector 43B is transmitted to controller 44, and this signal is further output from controller 44 to the electronic circuit in the vehicle. Finally, the set temperature of the air conditioner output near the driver's seat can be forced to increase.

To decrease the set temperature, knob 41B is rotated counterclockwise in the state that operation unit 41 is tilted to the direction of "Driver's seat TEMP." This detection signal is then output and the set temperature of the air conditioner output can be forced to lower.

In the same way, when operation unit 41 is rocked leftward, the temperature control of the air conditioner output near the passenger seat becomes available. When operating knob 41 is rocked upward, the display screen size of navigation system can be enlarged or reduced. When rocked downward, the volume control of audio equipment becomes available. In other words, an apparatus which needs to be controlled is selected by tilting operation unit 41 to one of left, right, up and down; and the setting of the selected apparatus is adjustable by rotating knob 41B in the tilted state.

More specifically, knob 41B of operation unit 41 is first moved horizontally to rock, and apparatuses such as the air conditioner, audio equipment and navigation equipment are selected. Then, this knob 41B is kept in the tilted position and rotated to adjust these modes. Accordingly, the user can select and adjust multiple electronic apparatuses and their modes just by holding single knob 41B. This eliminates the need to visually check individual operation every time. This also reduces erroneous operation such as pushing of unintended buttons by mistake. The present invention thus offers easy operation.

In addition, one of displays 47 selected such as "Driver's seat TEMP" and AUDIO VOL" can be lighted when controller 44 detects the rocking direction of operation unit 41. This facilitates confirmation of which mode of which apparatus is selected.

In addition, more apparatuses and modes can be operated by holding single knob 41B and pushing button 41C provided at roughly the center of the top face of knob 41B. For example, the display of navigation system is selected by rocking operation unit 41, one of a plurality of menus displayed on the screen is selected by rotating operating knob 41B, and then button 41C is pushed. Through this pushing operation, the detection signal is output from push detector 43C, such as a push switch, controller 44 detects the detection signal, and finally one of the menus is selected.

As described above, the input device in this exemplary embodiment has operation unit 41, which can be rocked or horizontally moved and rotated, and controller 44. Controller 44 selects an intended electronic apparatus or its mode in response to the horizontal operation of operation unit 41, and adjusts the apparatus or mode in response to rotation. In other words, the user can select from multiple electronic apparatuses and their modes and adjust by horizontally moving and rotating single operation unit 41. Accordingly, a smaller input device that is less prone to erroneous operation and which is easier to operate, and the input unit employing this input device are achievable.

Furthermore, more apparatuses and modes can be operated by providing button 41B which can be pushed on operation unit 41 and push detector 43C for detecting the pushing pressure of button 41B.

Also, confirmation of the operating direction is made easier and thus the operation is further facilitated by providing lighting devices 48 on the rear face of displays 47 for lighting selected display 47 by controller 44 in response to the movement of operation unit 41.

Additionally, all displays 47 can be lighted at night or in dark places and one of displays 47 in a direction selected by rocking operation unit 41 can be lighted brighter among them.

The above description refers to the configuration that operation unit 41 rocks about the bottom end of shaft 41A as a fulcrum. The present invention is also applicable to the configuration that shaft 41A horizontally slides in opening 46A and operation unit 41 moves parallel to panel 46.

The above description refers to the push switch and rotary encoder for horizontal movement detector 43A, rotation detector 43B and push detector 43C. However, other diverse electronic components including switches with different operating styles, light-detecting elements such as photo interrupters, and magnetism-detecting elements such as hall elements are also applicable to these detectors.

Also, operation unit 41 is operated in four directions: up, down, left and right, in the description. However, operation unit 41 can be operated in other directions including two directions and six directions, depending on the purposes intended. A plurality of modes of one apparatus such as temperature and air volume of an air conditioner, or sound volume and tone of audio equipment can also be selected by the movement of operation unit 41.

Furthermore, the above description refers to ring groove 12C for retaining operation unit 41 in a tilted state. However, the present invention can also be designed for auto-recovery to the neutral position upon releasing the hand after tilting operation unit 41. Or, controller 44 can be integrally provided on the electronic circuit in the vehicle.

As described above, the input device and the input unit employing this input device are downsized, less prone to erroneous operation, and easier to operate, and thus they are advantageous for controlling and operating a range of electronic apparatuses installed chiefly in vehicles.

What is claimed is:

1. An input device comprising:

a multi-way operation switch including a case, an operation unit mounted to said case so as to be rotatable relative to said case, a rotation-detection arrangement, including a rotation-detection switch contact, configured to detect rotation of said operation unit relative to said case, a lateral-movement-detection arrangement including a plurality of lateral-movement-detection switch contacts mounted to said case, wherein said operation unit comprises an operating portion, and a working member including a rotation shaft having a rotation axis, said working member further including a switch-contact-pressing part fixed with said rotation shaft and protruding laterally away from said rotation shaft, wherein said operation unit is mounted in said case in a rockable manner so that said rotation shaft and said switch-contact-pressing part are pivotally tilted relative to said case upon application of a lateral force to said operating portion, and wherein said switch-contact-pressing part is arranged so as to selectively operate one of said lateral-movement-detection switch contacts when said rotation shaft and said switch-contact-pressing part are pivotally tilted relative to said case due to application of the lateral force to said operating portion of said operation unit in a selected direction; and a controller operably coupled to said rotation-detection arrangement and said lateral-movement-detection arrangement and configured to select an electronic apparatus corresponding to the one of said lateral-movement-detection switch contacts selectively operated by said switch-contact-pressing part, and to control the selected electronic apparatus based on the rotation of said operation unit relative to said case as detected by said rotation-detection arrangement.

2. The input device as defined in claim 1, wherein said switch-contact-pressing part comprises a plurality of arms fixed to and extending laterally away from said rotation shaft to selectively operate said lateral-movement-detection switch contacts.

3. The input device as defined in claim 2, wherein said lateral-movement-detection arrangement further includes a first detector, operably coupled to said lateral-movement-detection switch contacts and to said controller, for detecting an operated switch from among said lateral-movement-detection switch contacts and outputting a detection signal to said controller; and said rotation-detection arrangement further includes a second detector, operably coupled to said rotation-detection switch contact and to said controller, for detecting a rotation of said operation unit and outputting a detection signal to said controller.

4. The input device as defined in claim 3, wherein said rotation shaft of said working member of said operation unit protrudes from within said case; and said operating portion of said operation unit comprises a knob exposed outside of said case and operably coupled to said rotation shaft.

5. The input device as defined in claim 3, wherein said operation unit of said multi-way operation switch further includes a button; and said multi-way operation switch further includes a push detector, operably coupled to said button and said controller, for detecting a pushing pressure of said button and outputting a detection signal to said controller.

6. An input unit comprising:

an input device as defined in claim 3; and a panel provided around said operation unit of said multi-way switch of said input device, said panel including a plurality of displays around said operation unit.

7. The input unit as defined in claim 6, further comprising a lighting device provided behind said displays and arranged to selectively light said displays; and wherein said lighting device is operably coupled to said controller such that said controller is operable to light a predetermined one of said displays corresponding to the selected one of the electronic apparatuses.

8. The input device as defined in claim 2, wherein said rotation shaft of said working member of said operation unit protrudes from within said case; and said operation unit further includes a knob exposed outside of said case and operably coupled to said rotation shaft.

9. The input device as defined in claim 2, wherein said operation unit of said multi-way operation switch further includes a button; and said multi-way operation switch further includes a push detector, operably coupled to said button and said controller, for detecting a pushing pressure of said button and outputting a detection signal to said controller.

10. An input unit comprising:

an input device as defined in claim 2; and a panel provided around said operation unit of said multi-way switch of said input device, said panel including a plurality of displays around said operation unit.

11. The input unit as defined in claim 10, further comprising a lighting device provided behind said displays and arranged to selectively light said displays; and wherein said lighting device is operably coupled to said controller such that said controller is operable to light a predetermined one of said displays corresponding to the selected one of the electronic apparatuses.

12. The input device as defined in claim 1, wherein said rotation shaft of said working member of said operation unit protrudes from within said case; and said operating portion of said operation unit comprises a knob exposed outside of said case and operably coupled to said rotation shaft.

13. The input device as defined in claim 1, wherein said operation unit of said multi-way operation switch further includes a button; and said multi-way operation switch further includes a push detector, operably coupled to said button and said controller, for detecting a pushing pressure of said button and outputting a detection signal to said controller.

14. An input unit comprising:

an input device as defined in claim 1; and a panel provided around said operation unit of said multi-way switch of said input device, said panel including a plurality of displays around said operation unit.

15. The input unit as defined in claim 14, further comprising a lighting device provided behind said displays and arranged to selectively light said displays; and wherein said lighting device is operably coupled to said controller such that said controller is operable to light a predetermined one of said displays corresponding to the selected one of the electronic apparatuses;

a panel provided around said operation unit of said multi-way switch of said input device, said panel including a plurality of displays around said operation unit.

* * * * *